US011278894B2

(12) United States Patent
Higgins et al.

(10) Patent No.: US 11,278,894 B2
(45) Date of Patent: Mar. 22, 2022

(54) TEMPERATURE-CONTROLLING MICROFLUIDIC DEVICES

(71) Applicant: Hewlett-Packard Development Company, L.P., Spring, TX (US)

(72) Inventors: Adam Higgins, Corvallis, OR (US); Alexander Govyadinov, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 214 days.

(21) Appl. No.: 16/643,693

(22) PCT Filed: Nov. 22, 2017

(86) PCT No.: PCT/US2017/062935
§ 371 (c)(1),
(2) Date: Mar. 2, 2020

(87) PCT Pub. No.: WO2019/103730
PCT Pub. Date: May 31, 2019

(65) Prior Publication Data

US 2020/0197930 A1 Jun. 25, 2020

(51) Int. Cl.
*B01L 7/00* (2006.01)
*B01L 3/00* (2006.01)

(52) U.S. Cl.
CPC ..... *B01L 3/50273* (2013.01); *B01L 3/502715* (2013.01); *B01L 7/52* (2013.01);
(Continued)

(58) Field of Classification Search
CPC .. B01L 3/50273; B01L 3/502715; B01L 7/52; B01L 2200/027; B01L 2300/0627;
(Continued)

(56) References Cited

U.S. PATENT DOCUMENTS 6,501,654 B2 12/2002 O'Connor et al.
8,394,324 B2 3/2013 Bousse et al.
(Continued)

FOREIGN PATENT DOCUMENTS

EP 1203096 5/2002
WO 2008125927 10/2008
WO 2016122554 8/2016

OTHER PUBLICATIONS

Mahjoob et al., Rapid microfluidic thermal cycler for polymerase chain reaction nucleic acid amplification, International Journal of Heat and Mass Transfer 51, 2008, pp. 2109-2122.
(Continued)

*Primary Examiner* — Brian J. Sines
(74) *Attorney, Agent, or Firm* — Thorpe North & Western LLP

(57) ABSTRACT

The present disclosure is drawn to microfluidic devices. In one example, a microfluidic device can include a driver chip and a fluid chamber located over the driver chip. First and second microfluidic loops can have fluid driving ends and fluid outlet ends connected to the fluid chamber. The first and second microfluidic loops can include a portion thereof located outside a boundary of the driver chip. A first fluid actuator can be on the driver chip associated with the fluid driving end of the first microfluidic loop to circulate fluid through the first microfluidic loop. A second fluid actuator can be on the driver chip associated with the fluid driving end of the second microfluidic loop to circulate fluid through the second microfluidic loop.

15 Claims, 9 Drawing Sheets

(52) U.S. Cl.
CPC . *B01L 2200/027* (2013.01); *B01L 2300/0627* (2013.01); *B01L 2300/088* (2013.01); *B01L 2300/1827* (2013.01); *B01L 2400/0406* (2013.01)

(58) Field of Classification Search
CPC ..... B01L 2300/088; B01L 2300/1827; B01L 2400/046
See application file for complete search history.

(56) References Cited

U.S. PATENT DOCUMENTS

| | | | |
|---|---|---|---|
| 9,170,028 | B1 | 10/2015 | Beer et al. |
| 9,170,060 | B2 | 10/2015 | Beer et al. |
| 9,554,422 | B2 | 1/2017 | Coursey et al. |
| 2003/0175947 | A1 | 9/2003 | Liu et al. |
| 2009/0311713 | A1 | 12/2009 | Pollack et al. |
| 2010/0261230 | A1 | 10/2010 | Liu et al. |
| 2012/0101268 | A1 | 4/2012 | Elizarov et al. |
| 2015/0140645 | A1 | 5/2015 | Davies et al. |
| 2017/0058324 | A1 | 3/2017 | Balog et al. |
| 2018/0043356 | A1* | 2/2018 | Domingue ..... B01L 7/00 |

OTHER PUBLICATIONS

International Search Report dated Aug. 16, 2018 for PCT/US2017/062935, Applicant Hewlett-Packard Development Company, L.P.

* cited by examiner

TEMPERATURE-CONTROLLING MICROFLUIDIC DEVICES

BACKGROUND

Microfluidics relates to the behavior, control and manipulation of fluids that are geometrically constrained to a small, typically sub-millimeter, scale. Microfluidics can be particularly useful for dealing with very small volume fluid samples, such as fluid samples of several microliters or less. For example, microfluidics can be used to manipulate biological samples, such as bodily fluids or sample fluids containing biological molecules such as proteins or DNA. These and a variety of applications for microfluidics exist, with various applications using differing controls over fluid flow, mixing, temperature, and so on.

BRIEF DESCRIPTION OF THE DRAWINGS

Additional features and advantages of the disclosure will be apparent from the detailed description which follows, taken in conjunction with the accompanying drawings, which together illustrate, by way of example, features of the present technology.

Figure 1:
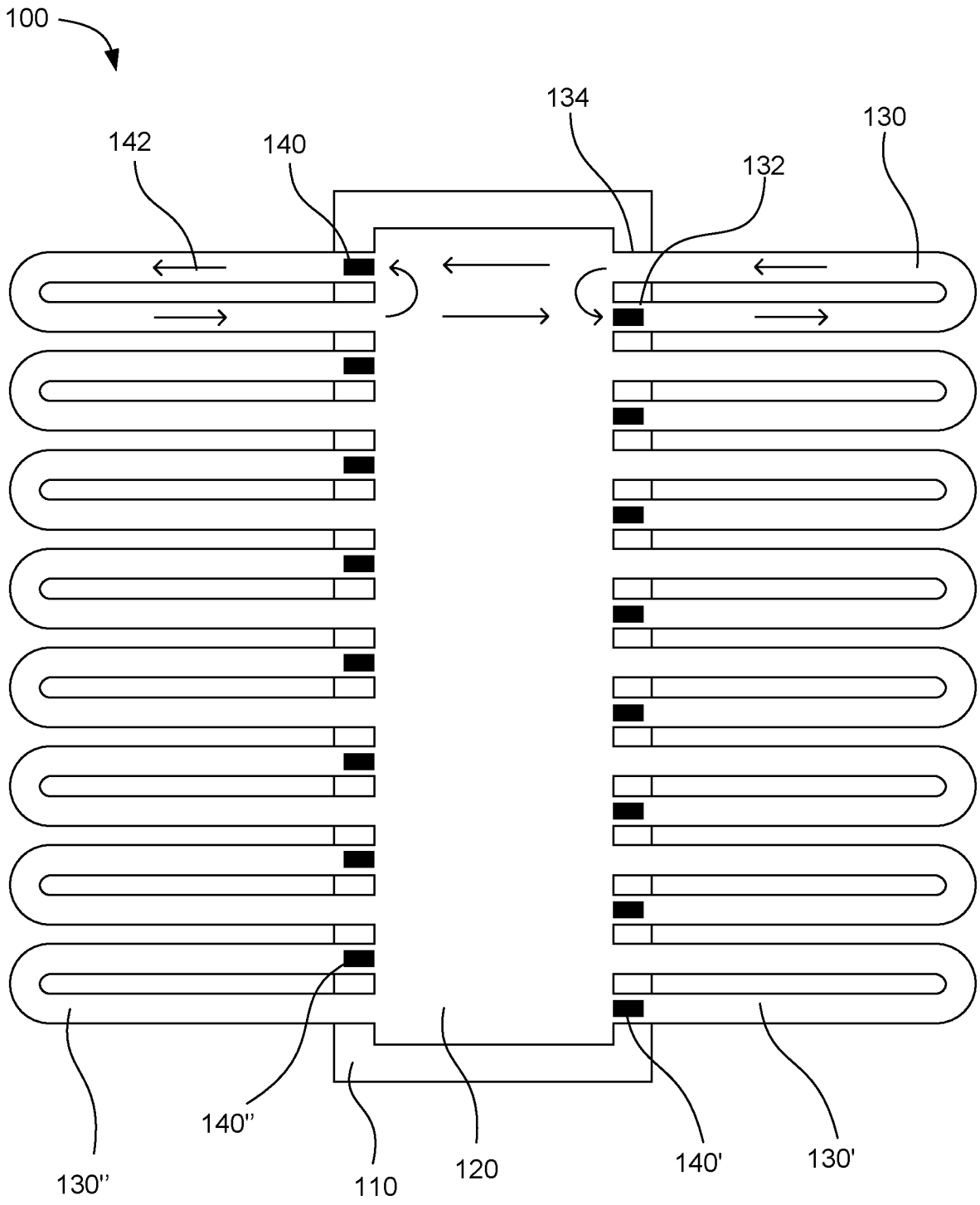
FIG. 1 is a schematic view of an example temperature-controlling microfluidic device in accordance with the present disclosure.

Reference will now be made to several examples that are illustrated herein, and specific language will be used herein to describe the same. It will nevertheless be understood that no limitation of the scope of the disclosure is thereby intended.

DETAILED DESCRIPTION

The present disclosure is drawn to temperature-controlling microfluidic devices and systems for controlling a temperature of a fluid. In some examples, these devices and systems can be used for nucleic acid (DNA) amplification. DNA amplification can be used to generate thousands or millions of copies of a DNA molecule, starting with only one or a few DNA molecules. Polymerase chain reaction (PCR) can be one example of a technique for amplifying nucleic acids. In this technique, a sample of fluid to be tested for DNA can be cyclically heated to a high temperature and cooled to a lower temperature. At the high temperature, the DNA molecule can be denatured by breaking hydrogen bonds between complementary bases in the DNA, yielding two single-stranded DNA molecules. At the low temperature, primers can be annealed to the single-stranded DNA molecules and DNA polymerize extends the new DNA strand by adding additional bases to the primers. In some cases, the annealing and elongation can be performed at two different temperatures. The temperature cycle can be repeated several times to create many new copies of the DNA molecule.

Loop-mediated isothermal amplification (LAMP) can be another example DNA amplification technique. In this technique, the amplification can be performed at a single temperature. Both PCR and LAMP may have advantages and disadvantages in various applications.

DNA amplification can be performed with at least one DNA molecule present in a sample fluid to be amplified. The limit of detection in DNA testing can be defined in terms of the number of DNA molecules per volume of sample fluid that can be detected. Two strategies can potentially increase the limit of detection for DNA testing using amplification techniques. The first strategy can be to concentrate DNA from a relatively large volume into a smaller volume for testing. The second strategy can be to increase the volume of fluid tested. This second strategy can be simpler than the first. However, when microfluidic devices are used to perform the DNA testing, it can be cost prohibitive to scale up the size of the microfluidic device to accommodate a large sample volume. Microfluidic devices can increase in cost roughly proportional to the amount of silicon used in their construction. Thus, microfluidic device formed on silicon chips can be very expensive when scaled up to test large sample volumes.

The microfluidic devices described herein can accommodate relatively larger sample sizes without proportionally increasing the amount of silicon used to construct the devices. The microfluidic devices can also provide good mixing of the sample fluid, high rates of heat transfer to the sample fluid, and good temperature control. In some examples, the volume of sample fluid can be increased without increasing the amount of silicon in the device by pumping sample fluid through microfluidic channels or loops that can be located off of the silicon chip. In some examples, the microfluidic channels or loops can increase the fluid volume in the device by 2 to 20 times without increasing the amount of silicon in the device by a proportional amount. The pumping action can also increase mixing and heat transfer to the fluid. In some examples, the fluid located in the microfluidic channels or loops and the fluid located over the silicon chip or chips in the device can have a nearly uniform temperature, such as a temperature variation of less than 4° C. throughout the device. The temperature uniformity can be affected by a variety of factors, such as pumping speed, insulation of the microfluidic channels or loops, and the optional provision of additional heaters located along the microfluidic channels or loops. These and other aspects are explained in further detail below.

In one example, a temperature-controlling microfluidic device can include a driver chip, a fluid chamber located over the driver chip, and a first microfluidic loop connected to the fluid chamber. Specifically, the first microfluidic loop can have a fluid driving end and a fluid receiving end connected to the fluid chamber. The first microfluidic loop can also include a portion thereof located outside a boundary of the driver chip. A first fluid actuator on the driver chip can be associated with the fluid driving end of the first microfluidic loop to circulate fluid through the first microfluidic loop. A second microfluidic loop can have a fluid driving end and a fluid outlet end connected to the fluid chamber. The second microfluidic loop can also include a portion thereof located outside a boundary of the driver chip. A second fluid actuator on the driver chip can be associated with the fluid driving end of the second microfluidic loop to circulate fluid through the second microfluidic loop.

In one example, the driver chip can include silicon. In a further example, the portion of the microfluidic loops outside the boundary of the driver chip can be on a silicon-free substrate.

In another example, the ratio of a first volume of fluid located outside the boundary of the driver chip to a second volume of fluid located over the driver chip can be from 2:1 to 20:1.

In yet another example, the fluid actuators can be thermal resistors or piezoelectric elements. In certain examples, the microfluidic loops can be distributed along opposing sides of an elongated fluid chamber, and locations of the fluid actuators can be staggered to increase mixing of fluid from the opposing sides.

In some examples, the driver chip can include a heater, a temperature sensor, a nucleic acid sensor, or a combination thereof.

In further examples, the microfluidic device can also include a second chip located under the microfluidic loops. The second chip can include a heater, a temperature sensor, a nucleic acid sensor, or a combination thereof.

In other examples, the microfluidic device can include a thermally insulating overlayer located over the microfluidic loops. The thermally insulating overlayer can be applied directly to the microfluidic loops or the thermally insulating overlayer can be separated from the microfluidic loops by spacers forming an air gap between the microfluidic loops and thermally insulating overlayer.

In another example, a microfluidic device can include a first driver chip, a second driver chip spaced apart from the first driver chip, a first fluid chamber located over the first driver chip, and a second fluid chamber located over the second driver chip. A first microfluidic channel can include a fluid driving end connected to the first fluid chamber and a fluid outlet end connected to the second fluid chamber. The first microfluidic channel can include a portion thereof located outside a boundary of the driver chips. A first fluid actuator can be on the first driver chip and associated with the fluid driving end of the first microfluidic channel to drive fluid through the first microfluidic channel to the second fluid chamber. A second microfluidic channel can have a fluid driving end connected to the second fluid chamber and a fluid outlet end connected to the first fluid chamber. The second microfluidic channel can include a portion thereof located outside a boundary of the driver chips. A second fluid actuator can be on the second driver chip and associated with the fluid driving end of the second microfluidic channel to drive fluid through the second microfluidic channel to the first fluid chamber.

In another example, the microfluidic device can also include a third chip located under the microfluidic channels. The third chip can include a heater, a temperature sensor, a nucleic acid sensor, or a combination thereof.

In other examples, a system for controlling a temperature of a fluid can include a temperature-controlling microfluidic device and a reading device. The temperature-controlling microfluidic device can include a first driver chip including a temperature sensor, a heater, and an electrical interface electrically connected to the temperature sensor and heater, and a second driver chip spaced apart from the first driver chip, wherein the second driver chip includes a temperature sensor, a heater, and an electrical interface electrically connected to the temperature sensor and heater. The microfluidic device can also include a first fluid chamber located over the first driver chip, a second fluid chamber located over the second driver chip, a first microfluidic channel having a fluid driving end connected to the first fluid chamber and a fluid outlet end connected to the second fluid chamber, wherein the first microfluidic channel includes a portion thereof located outside a boundary of the driver chips. A first fluid actuator can be on the first driver chip associated with the fluid driving end of the first microfluidic channel to drive fluid through the first microfluidic channel to the second fluid chamber. A second microfluidic channel can have a fluid driving end connected to the second fluid chamber and a fluid outlet end connected to the first fluid chamber. The second microfluidic channel can include a portion thereof located outside a boundary of the driver chips. A second fluid actuator on the second driver chip can be associated with the fluid driving end of the second microfluidic channel to drive fluid through the second microfluidic channel to the first fluid chamber. The reading device can include electrical interfaces to connect to the electrical interfaces of the driver chips, wherein the reading device includes a processor to drive the fluid actuators, measure temperatures using the temperature sensors, and heat the driver chips to control the temperature of the chips within a temperature range.

In a certain example, the driver chips can include silicon. In another example, the portions of the microfluidic channels outside the boundary of the driver chip are on a substrate that does not include silicon, e.g., a silicon-free substrate. In yet another example, the first driver chip can also include a nucleic acid sensor electrically connected to the electrical interface of the first driver chip.

The microfluidic devices described herein can be used for various DNA amplification techniques and many other applications that involve heating or cooling fluids in a microfluidic device. For example, the microfluidic devices can be used to perform temperature cycling for DNA amplification methods such as PCR. In one example, the temperature of the fluid in the device can be cycled between a high temperature and a low temperature over time. The fluid temperature can be spatially uniform throughout the device, i.e., at any point in time the entire fluid sample in the device can have a temperature variation of less than 4° C., while the fluid temperature can be cycled between the high and low temperatures over time. For PCR and some other chemical reactions, keeping the temperature within a temperature variation of less than 4° C. can be sufficient to allow the various reaction stages to proceed at the different temperatures. In further examples, the temperature uniformity can be even more precise, such as having a temperature variation of less than 2° C. or less than 1° C. throughout the microfluidic device.

Non-limiting examples of other tests that can be performed using the microfluidic devices described herein can include enzyme-linked immunoabsorbent assay (ELISA) immunoassay testing, isothermal amplification such as multiple displacement amplification (MDA), loop-mediated isothermal amplification (LAMP), rolling circle amplification (RCA), helicase-dependent amplification (HAD), recombinase polymerase amplification (RPA), nucleic acid sequence-based amplification (NASBA), hematology testing, and so on. A variety of other biochemical and non-biochemical tests can also benefit from the enhanced mixing and heat transfer provided by the microfluidic devices described herein.

In certain examples, a microfluidic device can include a driver chip with a fluid chamber located over the driver chip and multiple microfluidic loops connecting to the fluid chamber. As used herein, "microfluidic loops" refers to structures that can hold very small volumes of fluid, such as from a fraction of a picoliter to several microliters. Additionally, "microfluidic loops" are referred to as "loops" because they have two ends that connect to the same fluid chamber. The plurality of microfluidic loops can include a first microfluidic loop and a second microfluidic loop as mentioned above. As used herein, a "plurality" of microfluidic loops refers to at least two microfluidic loops, and can encompass any number of microfluidic loops two or greater. Similarly, a "plurality" of fluid actuators refers to any number of fluid actuators two or greater. The microfluidic loops can have a portion located outside a boundary of the driver chip, i.e., not located over the driver chip. Multiple fluid actuators such as thermal resistors or piezoelectric elements can be on the driver chip. These fluid actuators can be associated with the microfluidic loops to circulate fluid through the microfluidic loops. The fluid circulated through the microfluidic loops can be heated by heaters on the driver chip. In further examples, the driver chip can include temperature sensors and DNA sensors. Thus, the driver chip can be used to control the temperature of the sample fluid and detect DNA amplification in the sample fluid.

FIG. 1 shows an example microfluidic device 100. The device includes a driver chip 110 with a fluid chamber 120 located over the driver chip. Multiple microfluidic loops 130 individually can have a fluid driving end 132 and a fluid outlet end 134. The plurality of microfluidic loops can include a first microfluidic loop 130' and a second microfluidic loop 130". The microfluidic loops can be connected at the individual ends to the fluid chamber. As shown in the figure, a portion of the individual microfluidic loop can be located outside a boundary of the driver chip so that the portion is not on top of the driver chip. Multiple fluid actuators 140 can be on the driver chip. The plurality of fluid actuators can include a first fluid actuator 140' and a second fluid actuator 140". Individual fluid actuators can be associated with the fluid driving ends of individual microfluidic loops to circulate fluid through the microfluidic loops. The fluid circulates in the direction shown by flow arrows 142 in the figure. The fluid actuators pump the fluid around the microfluidic loops. When the fluid returns into the fluid chamber from the fluid outlet end of the microfluidic loops, a portion of the returned fluid circulates back to the fluid actuator to be pumped around the same microfluidic loop again. Another portion of the fluid can travel across the fluid chamber to be pumped through a microfluidic loop on the opposite side of the chamber. In this way, the fluid can be well mixed while the fluid actuators are running. In this example, the fluid actuators on either side of the fluid chamber can be placed in a staggered fashion to enhance mixing of fluid across the fluid chamber.

Figure 2:
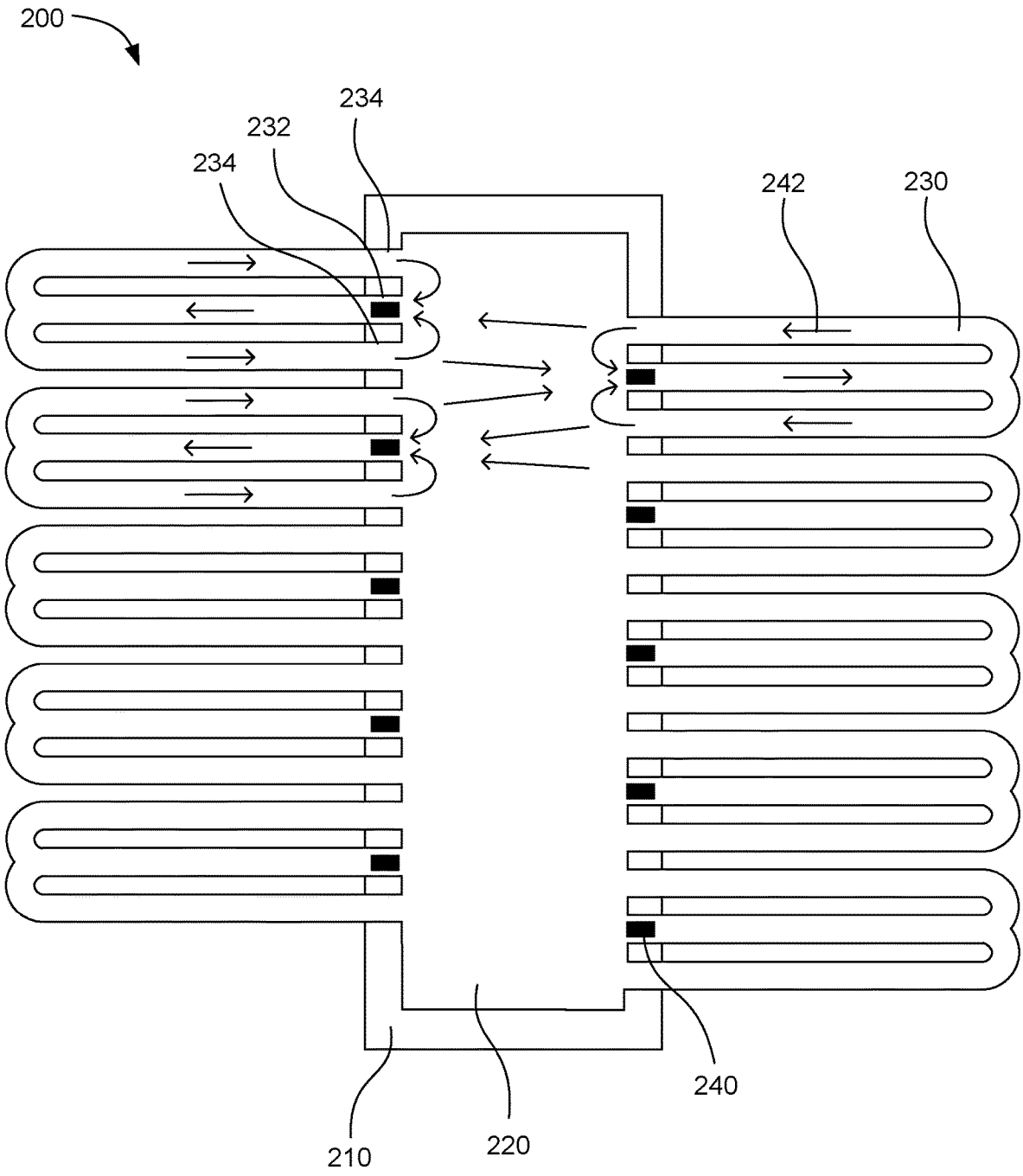
FIG. 2 is a schematic view of another example temperature-controlling microfluidic device in accordance with the present disclosure.

FIG. 2 shows another example microfluidic device 200. This device includes a driver chip 210 with a fluid chamber 220 over the driver chip. Multiple microfluidic loops 230 connect to the fluid chamber. The individual microfluidic loops have a fluid driving end 232 and then the microfluidic loops bifurcate so that the various loops have two separate fluid outlet ends 234. Fluid actuators 240 can be placed at the various fluid driving end to pump fluid through the microfluidic loops in the directions shown by flow arrows 242. Fluid can be pumped into the various microfluidic loop. When the microfluidic loop bifurcates, the fluid can be split into two halves that can return to the fluid chamber through separate fluid outlet ends. This can further enhance mixing of the fluid in the device. The fluid actuators on either side of the fluid chamber can be placed in a staggered fashion so that a portion of the fluid returning from the respective fluid outlet ends will travel across the fluid chamber and be pumped through a microfluidic loop on the opposite side of the fluid chamber.

In various examples, the driver chip can include the plurality of fluid actuators for pumping fluid through the microfluidic loops. In some examples, the fluid actuators can be a thermal resistor or a piezoelectric element. These actuators can be used to displace fluid, either by boiling the fluid to form a bubble in the case of thermal resistors, or by moving a piezoelectric element. The fluid actuator can be located in a microfluidic loop in a location that can be asymmetric with respect to the length of the microfluidic loop. In other words, the fluid actuator can be located closer to one end of the microfluidic loop than to the other. In certain examples, the fluid actuators can be located at or near the fluid driving end of a microfluidic loop. When the fluid actuator repeatedly displaces fluid, a net flow can be produced in one direction. For example, repeatedly forming bubbles using a thermal resistor can displace fluid into the microfluidic loop and produce a net flow of fluid from the fluid driving end of the microfluidic loop to the fluid outlet end of the microfluidic loop.

The fluid actuators can be formed on the driver chip by any suitable method, such as patterning resistors or piezoelectric elements on a surface of the driver chip. Other electronic components can also be formed on the driver chip, such as heaters, temperature sensors, and sensors for detecting a species in the sample fluid such as a DNA sensor. In some examples, the driver chip can also include electronics for powering and controlling the fluid actuators, heaters, and sensors. In further examples, a power source and control electronics can be in a separate device, and the driver chip can include an electrical interface that can connect to the separate device. In some examples, this arrangement can allow for a lower cost microfluidic testing device that can be disposable, with a separate reusable device for powering and controlling the fluid actuators, heaters, and sensors.

Figure 3A:
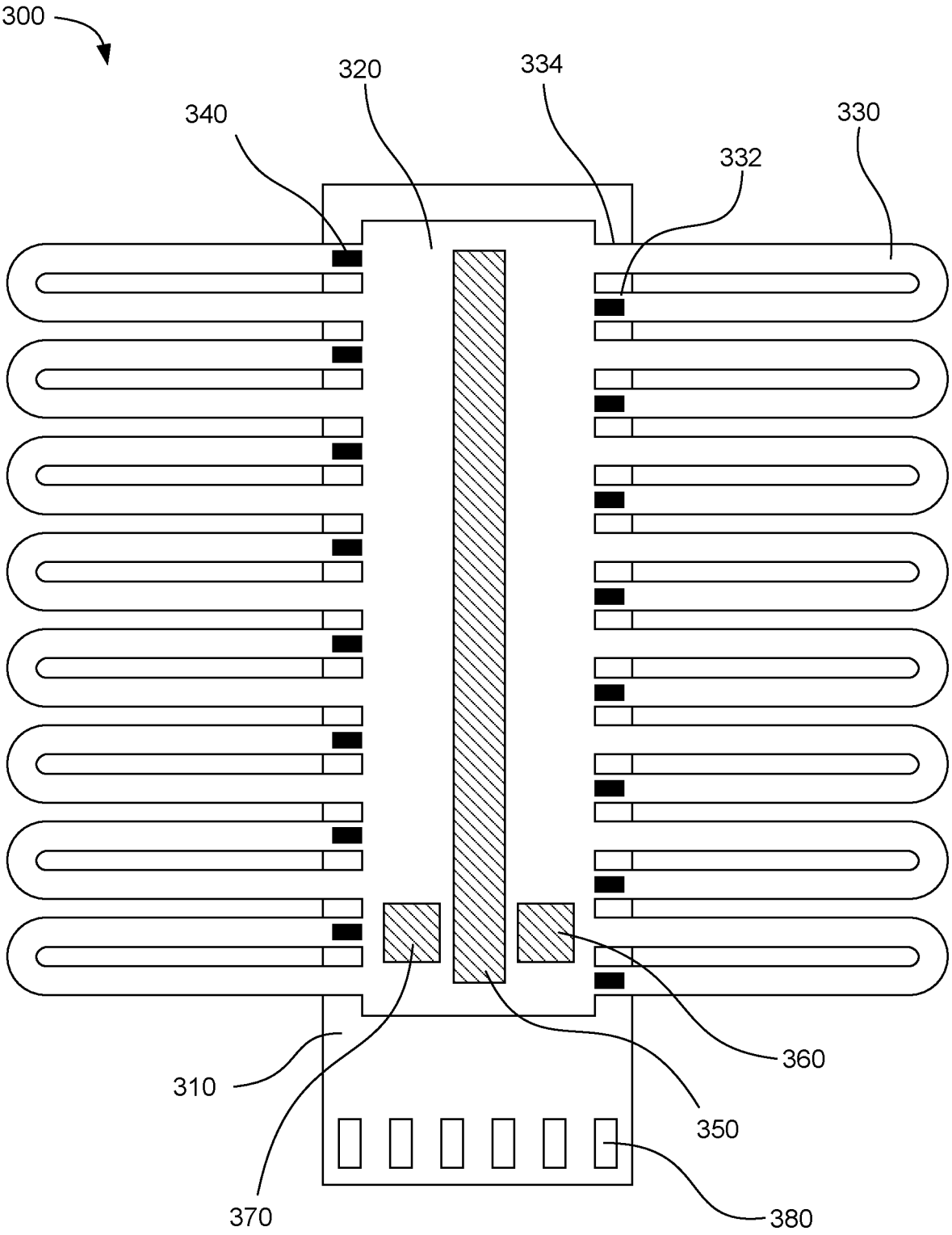
FIG. 3A is a top plan schematic view of an example temperature-controlling microfluidic device in accordance with the present disclosure.

FIG. 3A shows a top plan view of another example microfluidic device 300. This device includes a driver chip 310, a fluid chamber 320 over the driver chip, and microfluidic loops 330 that extend partially off of the driver chip. Fluid actuators 340 can be formed on the driver chip to pump fluid from the fluid driving ends 332 to the fluid outlet ends 334 of the microfluidic loops. In this example, the driver chip also includes a resistive heater 350 located on a surface of the driver chip for heating the fluid in the fluid chamber. A temperature sensor 360 can be located on the driver chip to measure the temperature of the fluid in the fluid chamber. A DNA sensor 370 can also be located on the driver chip to detect DNA amplification in the sample fluid. The fluid actuators, heater, temperature sensor, and DNA sensor can be all electrically connected to an electrical interface 380 on the driver chip through electrical traces (not shown).

In certain examples, the sample fluid temperature can be controlled using heaters and temperature sensors. In the device shown in FIG. 3A, the temperature sensor and the heater on the driver chip can connect to a controller to maintain a steady temperature of the sample fluid, and to cycle the temperature between high and low temperatures as desired. The temperature sensor, heater, and controller can be set up as a process control loop such as a PID loop.

In further examples, the device can include a sensor for sensing the presence of a particular species in the sample fluid. In the case of DNA sensors, an example sensor may be an optical sensor for detecting the presence of DNA molecules in the sample fluid. In a specific example, an optical sensor can detect fluorescence of a dye (also present in the sample fluid) that intercalates in the double-stranded DNA. Optical sensors can also be used with hydrolysis probes, which can be fluorescent dyes that can be released from primers embedded in copied DNA strands. In some examples, optical sensors can include a light source such as an LED. In particular, a blue LED can be used as the light source. The optical sensor can also include a photodetector with a high path filter to attenuate 3-6 orders of magnitude the exciting blue light. In further examples, electrochemical DNA sensors can be used. In certain examples, electrochemical sensors can produce an electrical signal in response to redox intercalating dye reacting with amplified DNA. In other examples, electrochemical sensors can selectively detect $H^+$ ions produced as a byproduct of DNA amplification. Ion sensitive field effect transistor (ISFET) sensors can be used for this purpose. In many examples, these sensors can be integrated into the driver chip or another chip in the microfluidic device.

As mentioned above, the driver chip can be formed of silicon. The size of the driver chip can be smaller than the size of the entire device so that the cost of the device can be minimized. In some examples, the driver chip can have a width of 200 μm to 1,000 μm. In further examples, the driver chip can have a width of 2 mm to 30 mm.

In further examples, the fluid chamber can be located over the driver chip. In certain examples, the driver chip itself can be the floor of the fluid chamber such that the fluid can be in direct contact with the driver chip and the electronic components on the driver chip. In other examples, the floor of the fluid chamber can be a thin layer of another material deposited over the driver chip. The thickness of this layer can be small to maximize heat transfer from the driver chip to the fluid in the fluid chamber. In some examples, the floor of the fluid chamber can be a layer of material that can be from 1 μm to 200 μm thick. In certain examples, the material can be a photoimageable epoxy such as SU-8.

Figure 3B:
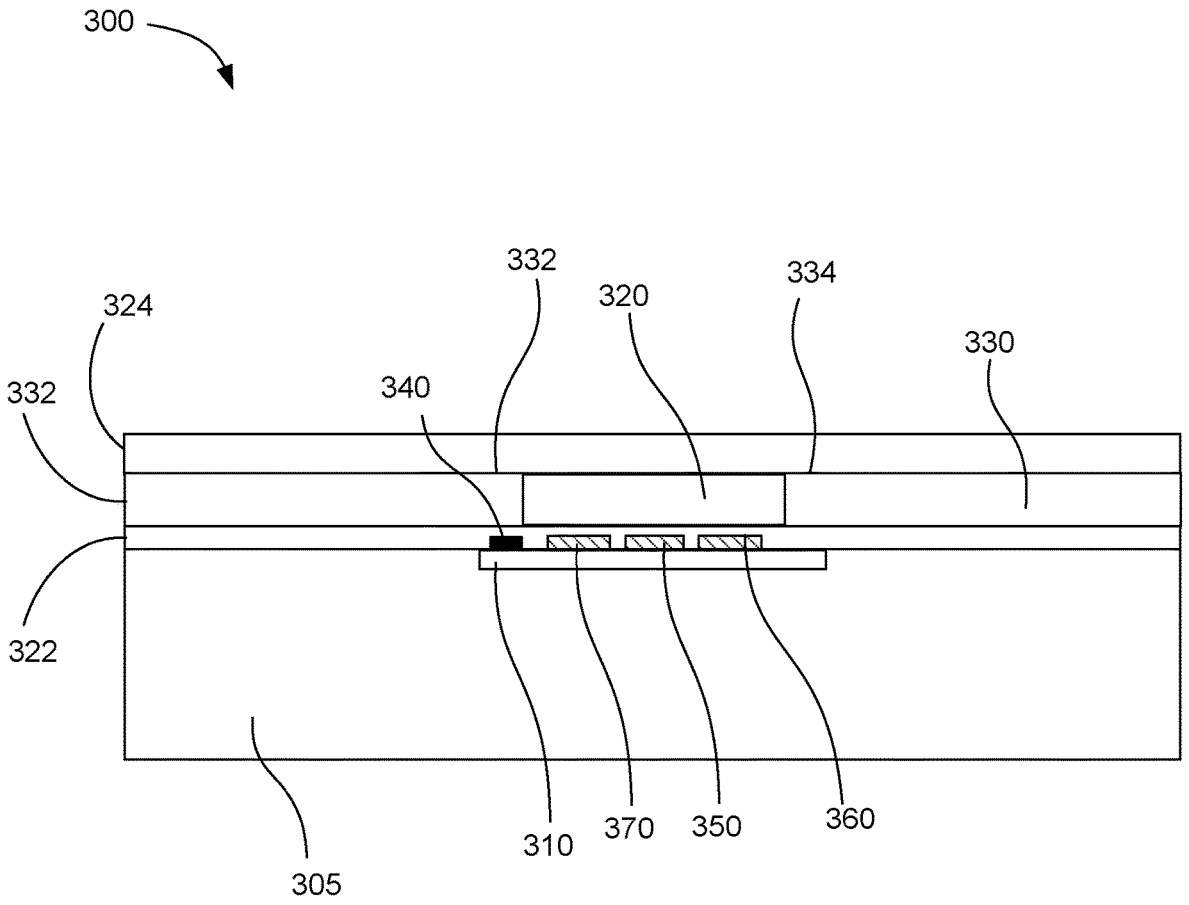
FIG. 3B is a side cross-sectional view of the example temperature-controlling microfluidic device shown in FIG. 3A.

FIG. 3B shows a cross-sectional side view of the microfluidic device 300 shown in FIG. 3A, to clarify the structure of the driver chip 310 and fluid chamber 320. In this example, the driver chip can be placed over a substrate 305. Fluid actuators 340, heater 350, temperature sensors 360, and DNA sensor 370 can be located on the surface of the driver chip. The fluid chamber can be formed by depositing a thin floor layer 322 over the driver chip. A microfluidic layer 332 can then be deposited to define the fluid chamber and microfluidic loops 330. Finally, a ceiling layer 324 can be deposited over the microfluidic layer.

In some examples, the fluid chamber can hold a volume of fluid from 3 pL to 2 μL. In certain examples, the fluid chamber can have a length of 50 μm to 10,000 μm, a width of 5 μm to 1,000 μm, and a height of 9 μm to 500 μm. In some cases, the height of the fluid chamber can be the same height as the microfluidic loops or channels that connect to the fluid chamber. In further examples, the microfluidic loops can account for a majority of the total fluid volume of the device. Thus, while the fluid chamber may hold a volume of from 3 pL to 2 μL, the total volume of fluid accommodated by the device may be from 6 pL to 40 μL or more.

In certain examples, the fluid chamber can have a ceiling with an opening for filling fluid into the chamber. In one example, the entire top of the fluid chamber can be open for filling fluid into the chamber. In another example, a majority of the fluid chamber can be closed by a ceiling, and a relatively small aperture can be located anywhere on the ceiling to allow for filling fluid into the chamber. Alternatively, an aperture can be formed in the driver chip and floor of the fluid chamber so that fluid can be filled into the fluid chamber through the driver chip. In a further example, the device can include a filling opening at another location and a microfluidic channel connecting the filling opening to the fluid chamber.

Microfluidic loops can extend at least partially off of the driver chip, as explained above. Longer microfluidic loops that extend farther off of the driver chip can further increase the total volume of fluid accommodated by the microfluidic device without increasing the chip size. In certain examples, the microfluidic loops can have a length from 50 μm to 10 mm. In some examples, from 80% to 100% of the length of the microfluidic loops can be located outside the boundaries of the driver chip and any other chips in the device. In further examples, from 90% to 99% of the length of the microfluidic loops can be located outside the boundaries of chips in the device. In further examples, the ratio of total fluid volume located outside the boundary of the driver chip to the total fluid volume over the driver chip can be from 2:1 to 20:1. The total fluid volume over the driver chip can include both fluid in the fluid chamber and fluid in any portions of the microfluidic loops that can be over the driver chip. In several examples, the small portion of the microfluidic loops can be over the driver chip so that the fluid actuators formed on the driver chip can be located within the microfluidic loops.

Additionally, in some examples the portions of the microfluidic loops that are outside the boundaries of the chips can be supported by a substrate that can be less expensive than the chip materials. For example, in one example the driver chip and other chips in the device can include silicon, and the substrate supporting the portion of the microfluidic loops can be a material other than silicon. In certain examples, the substrate can be a polymer, a photoimageable epoxy such as Su-8, glass, or another material.

In some examples, the microfluidic loops can have a cross-sectional area from 45 $\mu m^2$ to 500,000 $\mu m^2$. In certain examples, the microfluidic loops can have a rectangular cross section with a cross section width from 5 μm to 1,000 μm and a cross section height from 9 μm to 500 μm. In one example, the microfluidic loops can have the same height as the fluid chamber.

The microfluidic devices described are not limited to being formed by any particular process. However, in some examples, any of the microfluidic devices described herein can be formed from multiple layers as shown in FIG. 3B. In certain examples, the layers can be formed photolithographically using a photoresist. In one such example, the layers can be formed from an epoxy-based photoresist such as SU-8 or SU-8 2000 photoresist, which can be epoxy-based negative photoresists. Specifically, SU-8 and SU-8 2000 are Bisphenol A Novolac epoxy-based photoresists that are available from various sources, including MicroChem Corp. These materials can be exposed to UV light to become crosslinked, while portions that are unexposed remain soluble in a solvent and can be washed away to leave voids.

The use of longer microfluidic loops can often increase the amount of heat transferred from the fluid being circulated through the microfluidic loops to the substrate and/or to the surrounding environment. Accordingly, it may be difficult to maintain temperature uniformity with very long microfluidic loops extending off the driver chip. Accordingly, in some cases the length of the microfluidic loops can be selected so that the fluid circulating through the loops does not drop in temperature by more than 4° C. while the fluid circulates through the loops. In other examples, the amount of heat lost from the fluid in the microfluidic loops can be reduced by adding insulation to the microfluidic loops. In one example, a thermally insulating overlayer can be placed over the ceiling of the microfluidic loops. In another example, a thermally insulating overlayer can be separated from the microfluidic loops by spacers so that an air gap can be left between the microfluidic loops and the thermally insulating overlayer. In certain examples, the thermally insulating overlayer can be a sheet material such as a polymer, glass, nanofoam, ceramic, cellulose, and so on. In further examples, the thermally insulating overlayer can have a thickness from 0.1 μm to 5 mm and the air gap can have a thickness from 0.1 μm to 5 mm.

Figure 4:
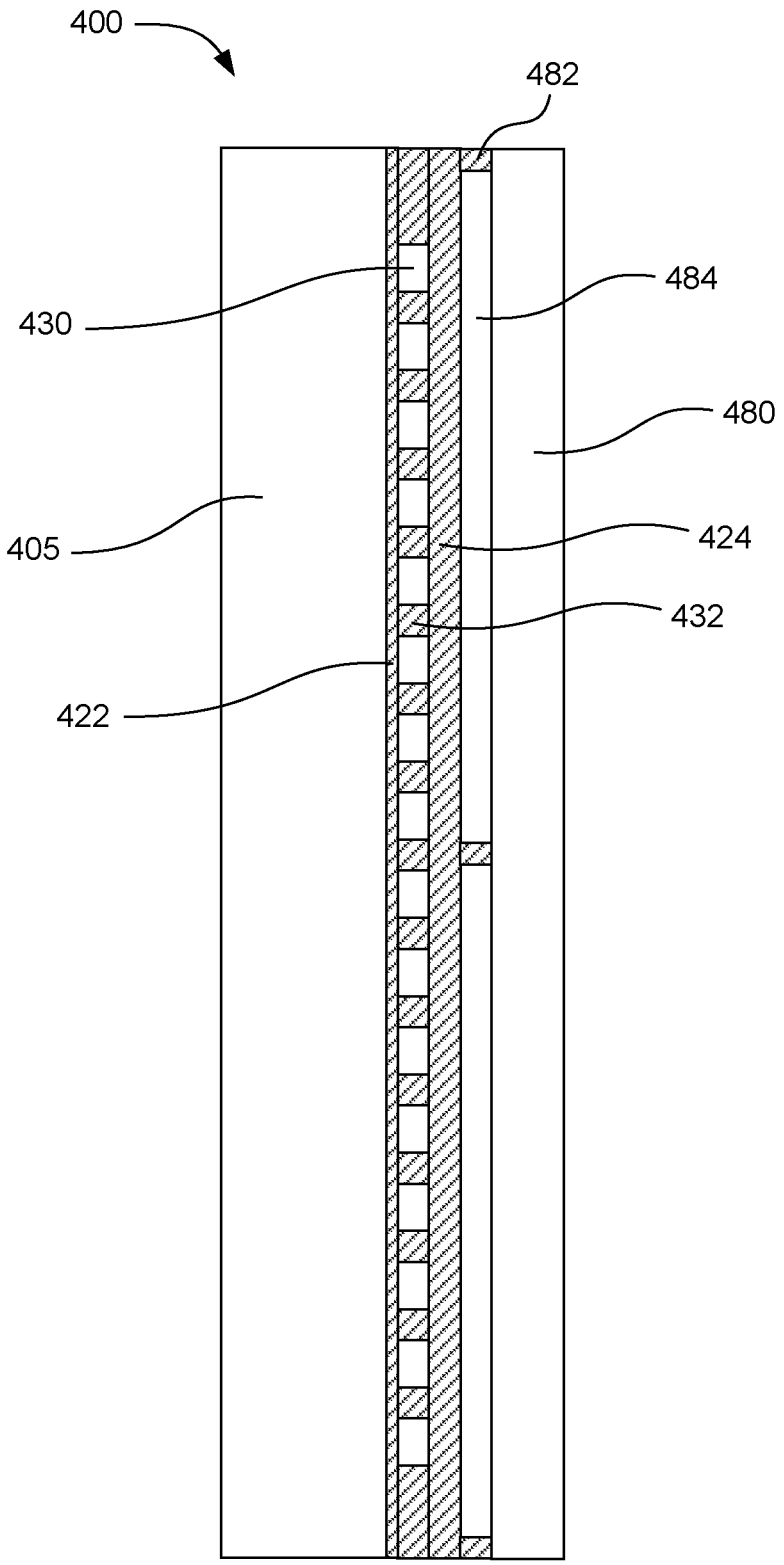
FIG. 4 is a side cross-sectional view of an example temperature-controlling microfluidic device in accordance with the present disclosure.

FIG. 4 shows a side cross-sectional view of an example microfluidic device 400. This example includes a thermally insulating overlayer 480 over the microfluidic loops 430. The thermally insulating overlayer can be separated from the ceiling layer 424 of the microfluidic loops by spacers 482. An air gap 484 can be located between the ceiling and the thermally insulating overlayer. The microfluidic loops can be defined by the material of microfluidic layer 432 which can be deposited over a floor layer 422. The floor layer can be deposited onto a substrate 405. In this example, the amount of heat lost to the environment through the ceiling of the microfluidic loops can be reduced by the thermally insulating overlayer and the air gap.

In other examples, the temperature uniformity of fluid in the microfluidic loops can be increased by including additional heating chips in the device. Additional chips can be located at locations distributed along the microfluidic loops. If the microfluidic loops are long enough that a significant temperature drop occurs before the fluid can circulate all the way around the loop, then the additional chips can be used to reheat the fluid back to the target temperature. The additional chips can include heaters, temperature sensors, sensors for detecting species in the sample fluid, or any combination thereof. In some examples, the number of additional chips in the device can be selected together with the length of the microfluidic loops so that the temperature of fluid in the microfluidic loops does not vary more than 4° C. as the fluid travels around the microfluidic loop.

Figure 5:
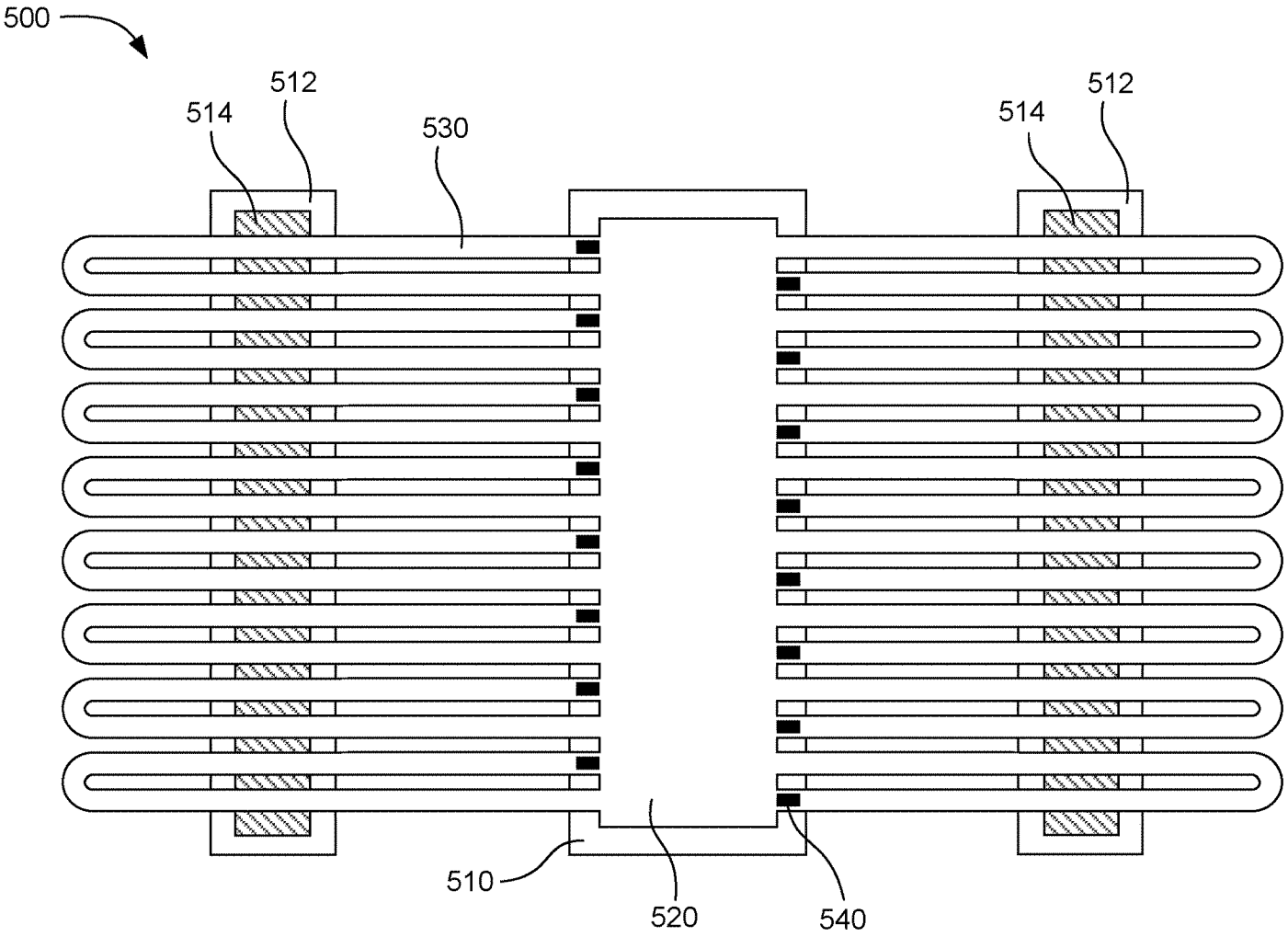
FIG. 5 is a schematic view of another example temperature-controlling microfluidic device in accordance with the present disclosure.

FIG. 5 shows an example microfluidic device 500 that includes two additional heating chips 512 in addition to the driver chip 510. Fluid can be pumped from the fluid chamber 520 through the microfluidic loops 530 by fluid actuators 540. The additional heating chips include heaters 514 to reheat fluid passing over the heating chips. In this way, the length of the microfluidic loops can be increased while maintaining temperature uniformity of the fluid in the loops.

In other examples, a microfluidic device can include two driver chips and two fluid chambers located over the driver chips. Instead of microfluidic loops that connect to a single fluid chamber at the various end, these examples can include microfluidic channels that lead from one fluid chamber to the other fluid chamber. As used herein, "microfluidic channels" refers to structures that can hold very small volumes of fluid, such as from a fraction of a picoliter to several microliters. Additionally, "microfluidic channels" are differentiated from microfluidic loops in that loops have two ends that both connect to a single fluid chamber, whereas channels have two ends that connect to different fluid chambers. In some examples, fluid actuators can be located at alternating ends of the microfluidic channels so that fluid can be pumped back and forth between the two fluid chambers through alternating microfluidic channels.

Figure 6:
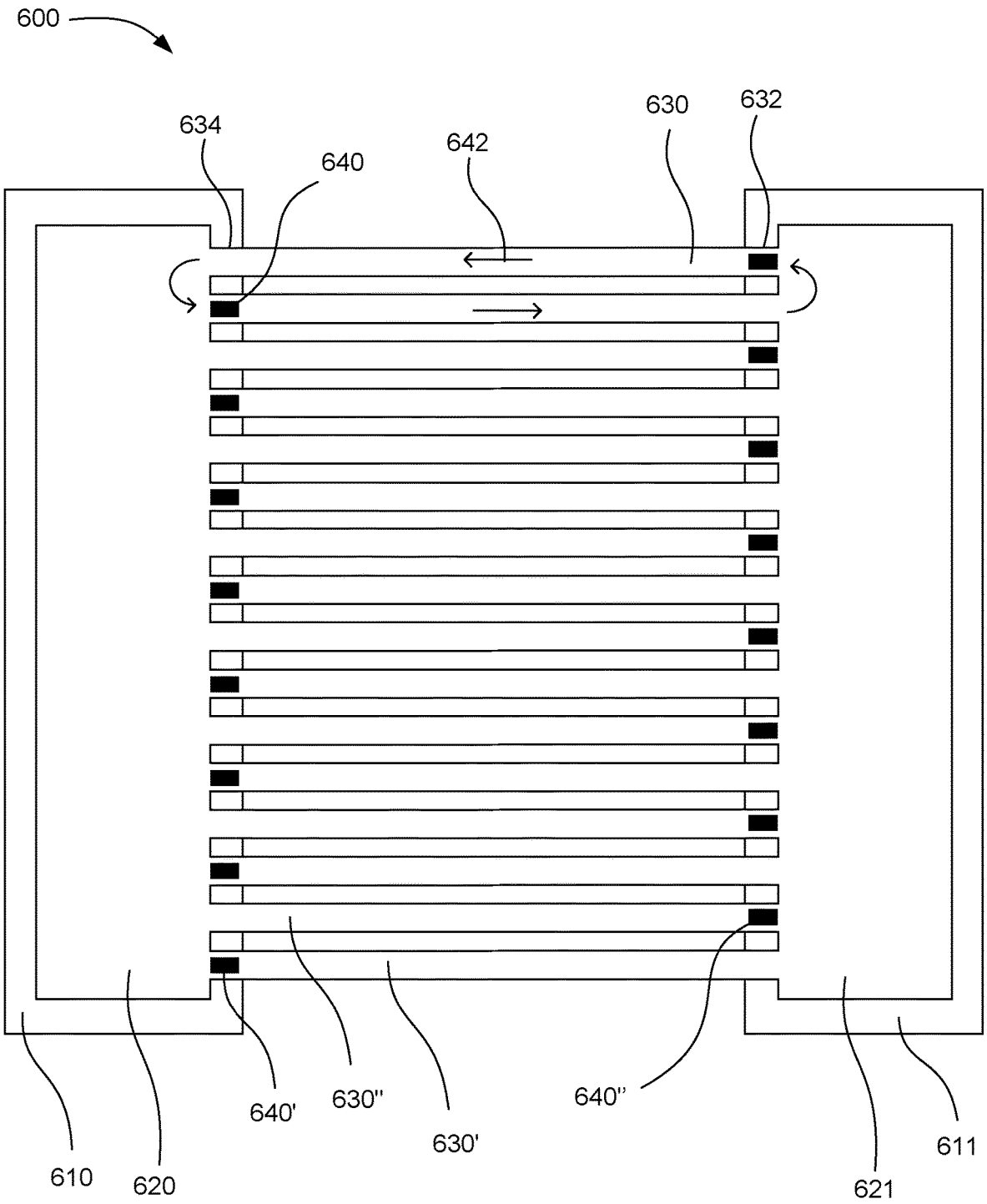
FIG. 6 is a schematic view of yet another example temperature-controlling microfluidic device in accordance with the present disclosure.

FIG. 6 shows one such example microfluidic device 600. This device includes a first driver chip 610 and a second driver chip 611. A first fluid chamber 620 can be located over the first driver chip and a second fluid chamber 621 can be located over the second driver chip. Microfluidic channels 630 connect to the first and second fluid chambers at either end of the individual microfluidic channels. The microfluidic channels can include a first microfluidic channel 630' and a second microfluidic channel 630". The microfluidic channels can have a fluid driving end 632 connected to one fluid chamber and a fluid outlet end 634 connected to the other fluid chamber. Fluid actuators 640 can be located at the fluid driving end of the individual microfluidic channels. The fluid actuators can include a first fluid actuator 640' and a second fluid actuator 640". The fluid actuators can pump fluid back and forth from the first fluid chamber to the second fluid chamber and back, in the directions shown by flow arrows 642.

In further examples, a variety of microfluidic devices can include two or more driver chips with two or more fluid chambers. These devices can include any of the other components and features described above, such as additional chips, thermally insulating overlayers, and so on. Microfluidic channels connecting fluid chambers together can have any of the dimensions and properties of the microfluidic loops described above. In certain examples, the total fluid volume located over driver chips and any additional chips in the device can be smaller than the fluid volume located outside the boundaries of these chips. In a particular example, the ratio of volume outside the boundaries of the chips to the volume over the chips can be from 2:1 to 20:1. As explained above, the volume over the chips can include the volume of fluid chambers located over the chips together with any portions of microfluidic channels located over the chips.

Figure 7:
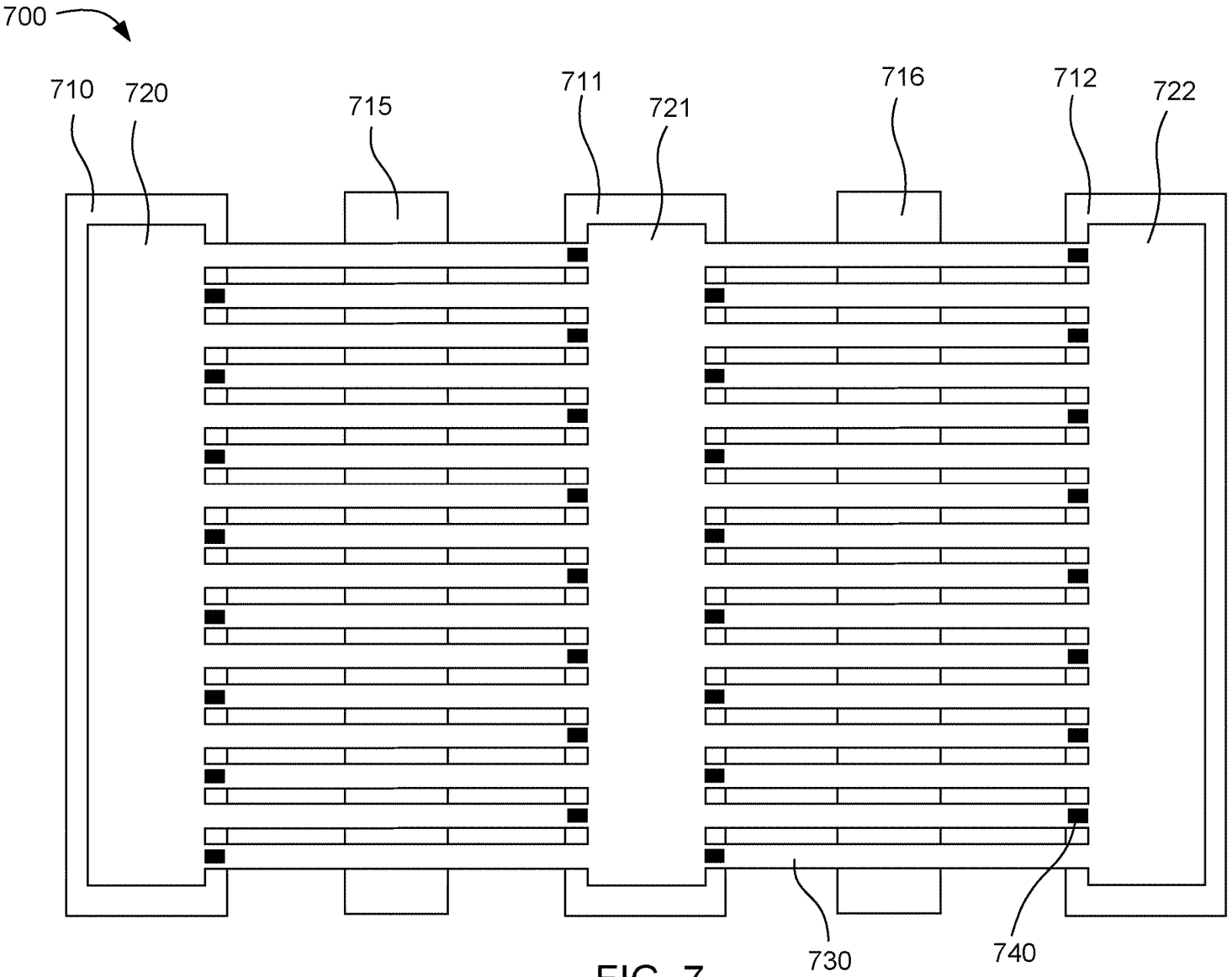
FIG. 7 is a schematic view of still another example temperature-controlling microfluidic device in accordance with the present disclosure.

FIG. 7 shows another example microfluidic device 700. This device includes three driver chips 710, 711, 712, and three fluid chambers 720, 721, 722 located over the driver chips. Microfluidic channels 730 connect the fluid chambers one to another. Fluid actuators 740 located on the driver chips can pump fluid from one fluid chamber to another. Two additional chips 715, 716 can be located under the microfluidic channels. These additional chips can include heaters, temperature sensors, sensors for detecting species such as DNA, or combinations thereof.

A variety of other configurations can be used with various numbers of driver chips and additional chips, with microfluidic channels and/or microfluidic loops. It should be understood that the figures and description above are not to be considered limiting unless otherwise stated. The microfluidic devices can include a variety of other components and features that are not depicted in the figures, such as capillary breaks, vents, valves, and any other suitable features.

As explained above, the microfluidic devices described herein can be used for a variety of application, especially applications involving mixing and heating of fluids. In some examples, the movement of fluid over heaters in the driver chip or heating chips can allow for fast temperature cycling of fluid in the device. This can be especially useful for PCR testing, which involves cycling the sample fluid between a high and low temperature many times.

In one example, the microfluidic devices described herein can be used to perform a method of heating and cooling a fluid. One example method can include loading a fluid sample into a fluid chamber located over a driver chip, respectively. The fluid sample can be driven from the fluid chamber into multiple microfluidic channels or loops, where individual microfluidic channels or loops include a fluid driving end, a fluid outlet end, and a portion therebetween that can be located outside a boundary of the driver chip. The driving of the fluid can be repeated to circulate the fluid through the microfluidic loops or channels. The fluid can simultaneously be temperature cycled by heating and cooling the entire fluid sample throughout the device, so that the fluid sample maintains a spatially uniform temperature within a 4° C. temperature difference throughout the fluid chamber and the plurality of microfluidic channels or loops.

In the particular case of PCR DNA testing, the microfluidic device can be loaded with a fluid to be tested for DNA. The sample fluid can be heated to a high relative temperature range to denature the nucleic acid. The sample fluid can then be cooled to a low relative temperature range to anneal primers in the sample fluid and synthesize new nucleic acid strands. In certain examples, the high relative temperature range can be from 80° C. to 103° C., and the low relative temperature range can be from 48° C. to 82° C. In further examples, the sample fluid can be held at the high relative temperature for a hold time from 1 second to 30 seconds, and then held at the low relative temperature for a hold time from 1 second to 30 seconds. In some examples, the temperature can be cycled from the high temperature to the low temperature and back 10 to 100 times during the DNA test.

In some examples, a three-temperature cycle can be used. The cycle can begin by holding the sample fluid at a high relative temperature of 90° C. to 100° C., then holding at a low relative temperature of 50° C. to 65° C., and then holding at an intermediate temperature of 70° C. to 82° C. These three temperatures can be repeated to multiply the DNA molecules. The high, low, and intermediate temperatures can correspond to denaturation, annealing, and elongation stages in the PCR reaction, respectively.

The driver chip or an additional chip in the device can include a DNA sensor for detecting DNA amplification in the sample fluid. For example, the DNA sensor can be an optical sensor that can optically detect the presence of amplified DNA molecules in the sample fluid.

In some examples the microfluidic device can be used together with a reading device that connects to the microfluidic device through electrical interfaces. The reading device can perform a variety of functions, such as providing power to the fluid actuators, heaters, and sensors of the microfluidic device. In some examples the reading device can include a processor that can be configured to receive signals from the sensors of the microfluidic device and control the heaters and fluid actuators of the microfluidic device. The processors can also be programmed to maintain chips in the microfluidic device at specific temperatures. More complex programs can be used for performing specific procedures with the microfluidic device, such as a PCR amplification test. In some examples, such programs can be more complex than simply holding the chip temperatures at certain values. For example, a PCR program may include initiation operations, ramp up of temperature in the driver chips, controlling the pumping speed of the fluid actuators, performing a specific number of cycles of fluid through the microfluidic loops, cycling the temperature of the fluid, detecting the presence of amplified DNA in the sample fluid, and a variety of other operations. Other functions that can be performed by the reading device can include storing data, displaying test results to a user, receiving manual inputs from a user to change parameters of the test being performed by the microfluidic device, and so on.

The form factor of the reading device is not particularly limited. In some examples, the reading device can be a personal computer with an interface for connecting to the microfluidic device. In other examples, the reading device can be a specialized handheld device, a mobile device such as a smartphone or tablet with an interface for connecting to the microfluidic device, and so on.

Figure 8:
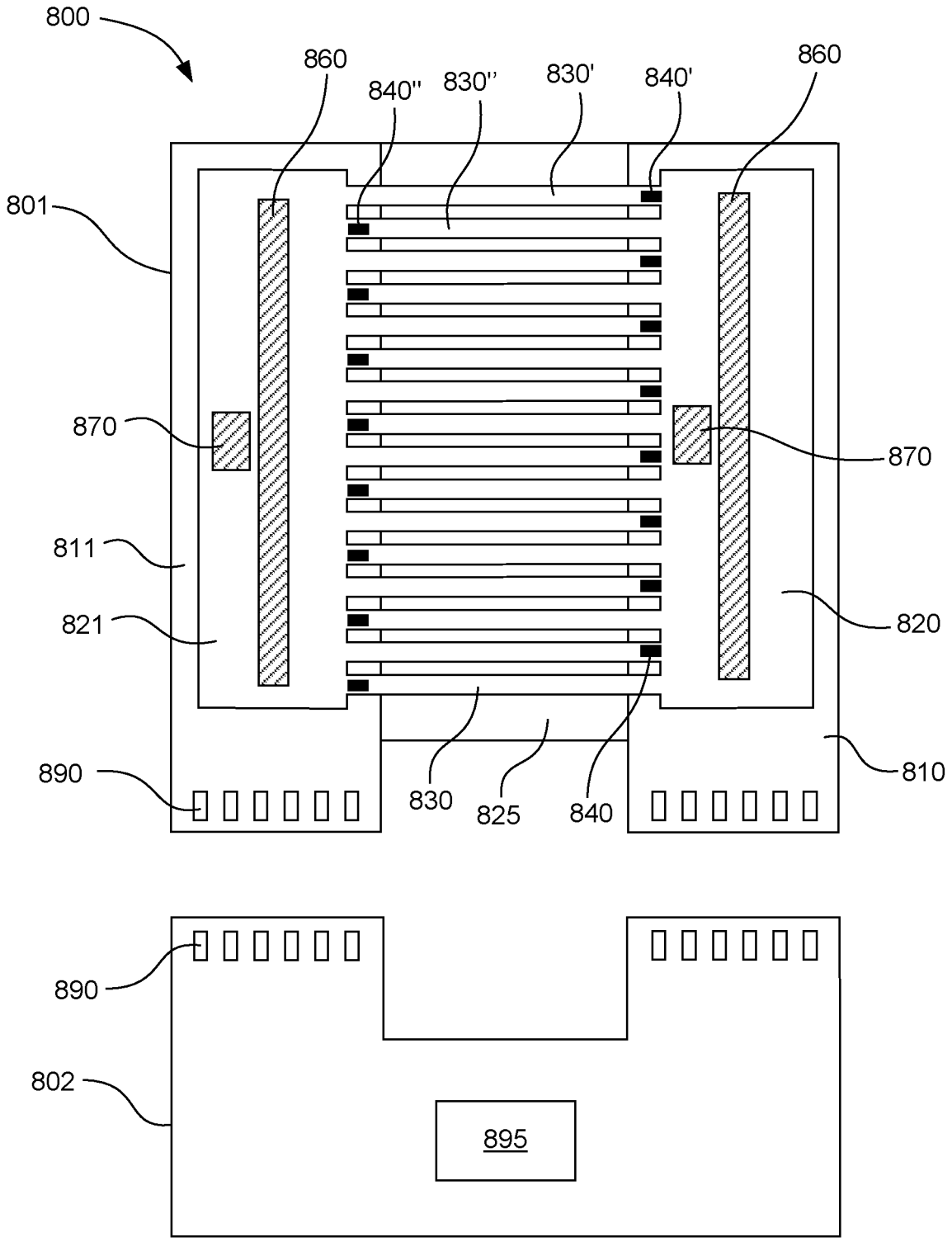
FIG. 8 is a schematic view of a system for controlling a temperature of a fluid in accordance with the present disclosure.

FIG. 8 shows an example system 800 for controlling a temperature of a fluid. The system includes a temperature-controlling microfluidic device 801 and a reading device 802. The microfluidic device includes a first driver chip 810, a second driver chip 811 separated from the first driver chip by a substrate 825, a first fluid chamber 820 over the first driver chip, a second fluid chamber 821 over the second driver chip, and multiple microfluidic channels 830 connecting the first and second fluid chambers. The plurality of microfluidic channels includes a first microfluidic channel 830' having a fluid driving end connected to the first fluid chamber and a fluid outlet end connected to the second fluid chamber. A portion of the first microfluidic channel is located outside a boundary of the driver chips. Multiple fluid actuators 840 are located on the first and second driver chips. The plurality of fluid actuators includes a first fluid actuator 840' located on the first driver chip associated with the driving end of the first microfluidic channel to drive fluid through the first microfluidic channel to the second fluid chamber. A second microfluidic channel 830" has a fluid driving end connected to the second fluid chamber and a fluid outlet end connected to the first fluid chamber. A portion of the second microfluidic channel is located outside a boundary of the driver chips. A second fluid actuator 840" is associated with the fluid driving end of the second microfluidic channel to drive fluid through the second microfluidic channel to the first fluid chamber. The first and second driver chips include a heater 860 and a temperature sensor 870. The driver chip and heat exchange chip also include electrical interfaces 890 connected to the heaters and temperature sensors. The reading device includes electrical interfaces that can connect to the electrical interfaces of the driver chip and heat exchange chip. The reading device also includes a processor 895 to measure temperatures using the temperature sensors and control the temperatures using the heaters of the microfluidic device. The processor can also control the fluid actuators to pump fluid through the microfluidic loops. In some examples, the driver chip and heat exchange chip may not necessarily have their own separate electrical interfaces. Rather, the microfluidic device as a whole can be designed to have a single electrical interface that can plug into the reading device through a port, cable, or the like.

A variety of other configurations can be used with various numbers of driver chips and heat exchange chips. The chips can include a variety of different electronic components, such as fluid actuators, heaters, temperature sensors, DNA sensors, and so on. It should be understood that the figures and description above are not to be considered limiting unless otherwise stated. The microfluidic devices can include a variety of other components and features that are not depicted in the figures, such as capillary breaks, vents, valves, and any other suitable features.

In one specific example, a microfluidic device is constructed according to the design shown in FIGS. 3A-3B. The driver chip is formed of silicon with thermal resistors formed thereon to be used as fluid actuators. A resistive heater, temperature sensor, and DNA sensor are also formed on the driver chip. The substrate surrounding the driver chip is SU-8 epoxy. A thin layer of SU-8 photoresist is coated over the driver chip as a floor for the fluid chamber and microfluidic loops. Another layer of SU-8 is then deposited and patterned by exposing the layer to UV light in the pattern of the walls of the microfluidic loops and the fluid chamber. Uncured SU-8 is then removed to form the fluid chamber and microfluidic loops. A ceiling is then deposited over the fluid chamber and microfluidic loops by dry laminating a photoresist layer over the microfluidic layer. The ceiling is patterned to leave an aperture open for filling the fluid chamber. The ceiling is then developed by removed uncured photoresist.

A sample fluid is filled into the fluid chamber. The sample fluid contains at least one DNA molecule to be amplified and a mixture of primers, bases, and polymerase for carrying out the amplification reactions. The microfluidic device is connected to a separate reading device through the electronic interface on the driver chip. The reading device includes electronics for power the fluid actuators, heater, temperature sensor, and DNA sensor on the driver chip. The reading device activates the fluid actuators at a frequency of 2 kHz to 30 kHz to circulate sample fluid through the microfluidic loops. The reading device performs a PCR amplification program by first heating the sample fluid, using the heater, to a high temperature of 95° C. for 30 seconds. The reading device measures the temperature of the fluid using the temperature sensor on the driver chip and maintains the temperature roughly constant for 30 seconds using a PID control loop. The DNA molecule in the sample fluid becomes denatured at the high temperature. The reading device then reduces the temperature of the fluid to a low temperature of 60° C. for 30 seconds to anneal primers to the denatured single stranded DNA molecules. The temperature is then increased to 75° C. for 30 seconds to add bases onto the primers to synthesize new DNA molecules. This cycle is then repeated until the DNA sensor detects the amplified DNA molecules in the sample fluid.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, the term "substantial" or "substantially" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, the term "about" is used to provide flexibility to a numerical range endpoint by providing that a given value may be "a little above" or "a little below" the endpoint. The degree of flexibility of this term can be dictated by the particular variable and determined based on the associated description herein.

As used herein, multiple items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

What is claimed is:

1. A temperature-controlling microfluidic device, comprising:

a driver chip;

a fluid chamber located over the driver chip;

a first microfluidic loop having a fluid driving end and a fluid outlet end connected to the fluid chamber, wherein the first microfluidic loop includes a portion thereof located outside a boundary of the driver chip;

a first fluid actuator on the driver chip associated with the fluid driving end of the first microfluidic loop to circulate fluid through the first microfluidic loop;

a second microfluidic loop having a fluid driving end and a fluid outlet end connected to the fluid chamber, wherein the second microfluidic loop includes a portion thereof located outside a boundary of the driver chip; and a second fluid actuator on the driver chip associated with the fluid driving end of the second microfluidic loop to circulate fluid through the second microfluidic loop.

2. The microfluidic device of claim 1, wherein the driver chip comprises silicon.

3. The microfluidic device of claim 2, wherein the portion of the microfluidic loops outside the boundary of the driver chip are on a silicon-free substrate.

4. The microfluidic device of claim 1, wherein a ratio of a first volume of fluid located outside the boundary of the driver chip to a second volume of fluid located over the driver chip is from 2:1 to 20:1.

5. The microfluidic device of claim 1, wherein the fluid actuators are thermal resistors or piezoelectric elements.

6. The microfluidic device of claim 1, wherein the microfluidic loops are distributed along opposing sides of an elongated fluid chamber, and locations of the fluid actuators are staggered to increase mixing of fluid from the opposing sides.

7. The microfluidic device of claim 1, wherein the driver chip comprises a heater, a temperature sensor, a nucleic acid sensor, or a combination thereof.

8. The microfluidic device of claim 1, further comprising a second chip located under the microfluidic loops, wherein the second chip comprises a heater, a temperature sensor, a nucleic acid sensor, or a combination thereof.

9. The microfluidic device of claim 1, further comprising a thermally insulating overlayer located over the microfluidic loops, wherein the thermally insulating overlayer is applied directly to the microfluidic loops or wherein the thermally insulating overlayer is separated from the microfluidic loops by spacers forming an air gap between the microfluidic loops and the thermally insulating overlayer.

10. A temperature-controlling microfluidic device, comprising:

a first driver chip;

a second driver chip spaced apart from the first driver chip;

a first fluid chamber located over the first driver chip;

a second fluid chamber located over the second driver chip;

a first microfluidic channel having a fluid driving end connected to the first fluid chamber and a fluid outlet end connected to the second fluid chamber, wherein the first microfluidic channel includes a portion thereof located outside a boundary of the driver chips;

a first fluid actuator on the first driver chip associated with the fluid driving end of the first microfluidic channel to drive fluid through the first microfluidic channel to the second fluid chamber;

a second microfluidic channel having a fluid driving end connected to the second fluid chamber and a fluid outlet end connected to the first fluid chamber, wherein the second microfluidic channel includes a portion thereof located outside a boundary of the driver chips; and a second fluid actuator on the second driver chip associated with the fluid driving end of the second microfluidic channel to drive fluid through the second microfluidic channel to the first fluid chamber.

11. The microfluidic device of claim 10, further comprising a third chip located under the microfluidic channels, wherein the third chip comprises a heater, a temperature sensor, a nucleic acid sensor, or a combination thereof.

12. A system for controlling a temperature of a fluid, comprising:

a temperature-controlling microfluidic device, including:

a first driver chip comprising a temperature sensor, a heater, and an electrical interface electrically connected to the temperature sensor and heater, a second driver chip spaced apart from the first driver chip, wherein the second driver chip comprises a temperature sensor, a heater, and an electrical interface electrically connected to the temperature sensor and heater, a first fluid chamber located over the first driver chip, a second fluid chamber located over the second driver chip, a first microfluidic channel having a fluid driving end connected to the first fluid chamber and a fluid outlet end connected to the second fluid chamber, wherein the first microfluidic channel includes a portion thereof located outside a boundary of the driver chips, a first fluid actuator on the first driver chip associated with the fluid driving end of the first microfluidic channel to drive fluid through the first microfluidic channel to the second fluid chamber, a second microfluidic channel having a fluid driving end connected to the second fluid chamber and a fluid outlet end connected to the first fluid chamber, wherein the second microfluidic channel includes a portion thereof located outside a boundary of the driver chips, and a second fluid actuator on the second driver chip associated with the fluid driving end of the second microfluidic channel to drive fluid through the second microfluidic channel to the first fluid chamber; and a reading device comprising electrical interfaces to connect to the electrical interfaces of the driver chips, wherein the reading device includes a processor to drive the fluid actuators, measure temperatures using the temperature sensors, and heat the driver chips to control the temperature of the chips within a temperature range.

13. The system of claim 12, wherein the first and second driver chips comprise silicon.

14. The system of claim 13, wherein the portions of the microfluidic channels outside the boundary of the first and second driver chips are on a silicon-free substrate.

15. The system of claim 12, wherein the first driver chip further comprises a nucleic acid sensor electrically connected to the electrical interface of the first driver chip.

* * * * *